US006857882B2

(12) United States Patent
Van Den Meersschaut

(10) Patent No.: US 6,857,882 B2
(45) Date of Patent: Feb. 22, 2005

(54) CONNECTION BLOCK SUITABLE FOR BEING INSERTED IN A CAVITY OF A METAL BOX OF A MULTICONTACT CONNECTOR

(75) Inventor: Bernard Van Den Meersschaut, Nazzelles-Negron (FR)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 10/358,087

(22) Filed: Feb. 4, 2003

(65) Prior Publication Data

US 2003/0157818 A1 Aug. 21, 2003

(30) Foreign Application Priority Data

Feb. 19, 2002 (FR) ..... 02 02079

(51) Int. Cl.[7] ..... H01R 13/648
(52) U.S. Cl. ..... 439/95; 439/607
(58) Field of Search ..... 439/92, 95, 101, 439/108, 607, 608

(56) References Cited

U.S. PATENT DOCUMENTS 5,190,479 A * 3/1993 Jordi ..... 439/620
5,286,210 A * 2/1994 Kilsdonk et al. ..... 439/95
5,304,964 A * 4/1994 DiMarco ..... 333/181
5,311,408 A * 5/1994 Ferchau et al. ..... 361/818
5,331,505 A * 7/1994 Wilheim ..... 361/306.3
5,346,403 A * 9/1994 Hyzin ..... 439/95
5,603,640 A 2/1997 Mouissie
5,622,506 A * 4/1997 Hornig et al. ..... 439/74
6,364,671 B1 * 4/2002 Verneau ..... 439/95

FOREIGN PATENT DOCUMENTS

EP 0 430 105 A 6/1991

* cited by examiner

*Primary Examiner*—P. Austin Bradley
*Assistant Examiner*—X. Chung-Trans
(74) *Attorney, Agent, or Firm*—Schweitzer Cornman Gross & Bondell LLP

(57) ABSTRACT

The present invention provides a connection block suitable for being inserted in a cavity of a metal box of a multicontact connector, the block comprising:

an insulating body having a bottom face and a top face together with a side wall extending substantially between said faces, said insulating body being provided with a plurality of holes designed to receive individual contacts, said holes extending between said bottom and top faces;

one or more housings each designed to receive a ground pin; and a metal ground element suitable for being electrically connected to the ground pin(s) inserted in said housing (s), said ground element having a contact wall configured in such a manner as to extend over at least a major portion of the periphery of said side wall.

13 Claims, 3 Drawing Sheets

CONNECTION BLOCK SUITABLE FOR BEING INSERTED IN A CAVITY OF A METAL BOX OF A MULTICONTACT CONNECTOR

The present invention relates to a connection block suitable for being inserted in a cavity of a metal box of a multicontact connector, and also to a multicontact connector including at least one such connection block.

BACKGROUND OF THE INVENTION

Connection blocks are known that are suitable for insertion in the cavity of a metal box of a multicontact connector, in particular of the ARINC type, such a block comprising an insulating body having bottom and top faces and a side wall extending substantially between said faces, said insulating body being provided with a plurality of holes for receiving individual contacts, the holes extending between said bottom and top faces, and with one or more housings each designed to receive a ground pin.

Each of the above-mentioned housings is provided with a split ring arranged so as to enable the ground pin to be held in the housing. The ring includes two resiliently deformable tabs projecting from the side wall of the insulating body and designed to provide electrical contact between the ground pin and the metal box.

Connection blocks of that type present various drawbacks.

Firstly, the above-mentioned tabs provide electrical contact area with the metal box that is relatively small, which can lead to poor electrical contact between the pin and the box, in particular when the electrical conductivity of the box is poor, as is the case for example when the box is made of aluminum alloy that has been treated by chromium plating.

In addition, when the connection block is subjected to mechanical stresses, in particular to vibration, the tabs can be damaged, or even broken.

OBJECTS AND SUMMARY OF THE INVENTION

The invention seeks to remedy the above-specified drawbacks.

The invention thus provides a connection block suitable for being inserted in a cavity of a metal box of a multicontact connector, the block comprising:

- an insulating body having a bottom face and a top face together with a side wall extending substantially between said faces, said insulating body being provided with a plurality of holes designed to receive individual contacts, said holes extending between said bottom and top faces;
- one or more housings each designed to receive a ground pin; and
- a metal ground element suitable for being electrically connected to the ground pin(s) inserted in said housing (s), said ground element having a contact wall configured in such a manner as to extend over at least a major portion of the periphery of said side wall.

By means of the invention, the contact area between the metal ground element and the wall of the cavity in the metal box is large, thus making it possible to achieve satisfactory electrical contact between the metal ground element and the metal box.

Advantageously, the above-mentioned contact wall is configured in such a manner as to extend over the entire periphery of the side wall of the insulating body.

Thus, in addition to the large electrical contact area between the metal ground element and the metal box, because of the contact wall surrounding the insulating body, this ground element presents good mechanical strength in the face of mechanical stresses, in particular vibration, to which the connection block might be subjected, which is particularly advantageous in aviation applications.

In an embodiment of the invention, the contact wall extends over at least a fraction of the height of the above-mentioned side wall.

The side wall of the insulating body and the contact wall of the metal ground element may each present a cross-section that is substantially rectangular.

The insulating body may comprise a bottom portion and a top portion that are separate and suitable for being assembled together, and the ground element may comprise one or more internal portions defining one or more housings each serving to receive a ground pin, said internal portion(s) optionally being sandwiched to a greater or lesser extent between the bottom and top portions of the insulating body when said portions are assembled together.

The metal ground element can thus be firmly fixed to the insulating body.

In an embodiment of the invention, each internal portion of the metal ground element has a cylindrical neck extending the corresponding housing and engaging in an orifice of corresponding shape in one of the portions of the insulating body.

The connection block may have one or more support rings suitable for being inserted in respective housings of the metal ground element and arranged in such a manner as to retain a ground pin in said housing.

The contact wall of the ground element may have regions that are taller than the height of the remainder of the contact wall.

The insulating body may have at least one bearing surface against which the metal ground element comes to bear.

In an embodiment of the invention, the bearing surface extends at the periphery of one of the portions of the insulating body.

The ground element may be made as a single piece, for example of aluminum alloy coated in a layer of nickel.

The invention also provides a multicontact connector comprising:

- a metal box having one or more cavities; and
- one or more connection blocks as described above, each inserted in a cavity of the box.

BRIEF DESCRIPTION OF THE DRAWINGS

Other characteristics and advantages of the present invention appear on reading the following detailed description of a non-limiting embodiment, and on examining the accompanying drawings, in which.

MORE DETAILED DESCRIPTION

Figure 1:
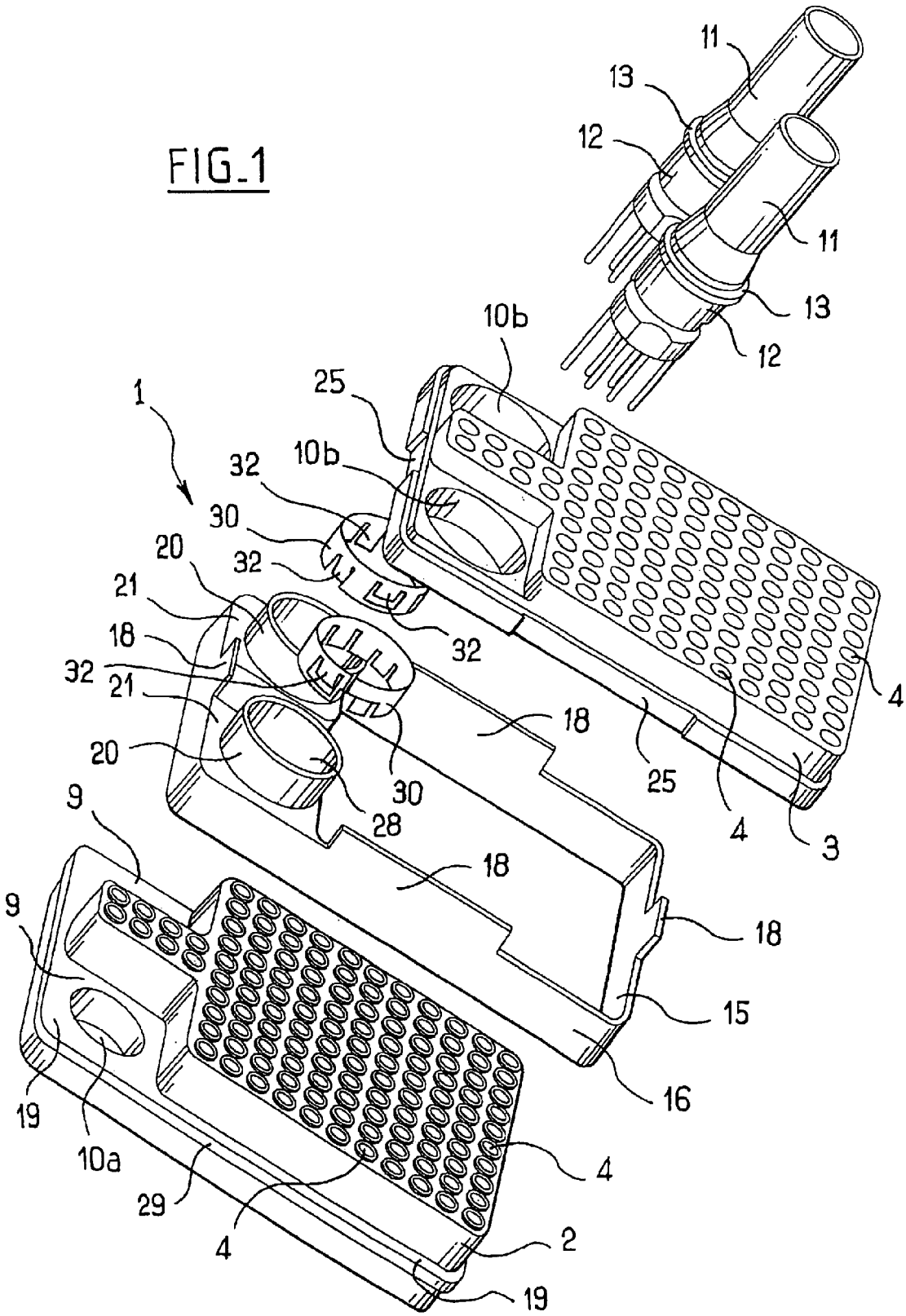
FIG. 1 is a diagrammatic and fragmentary exploded perspective view of the various elements of a connection block constituting an embodiment of the invention, prior to assembly.

The connection box 1 shown in FIG. 1 comprises an insulating body made up of a bottom portion 2 and a top portion 3 that are suitable for being assembled together.

Figure 2:
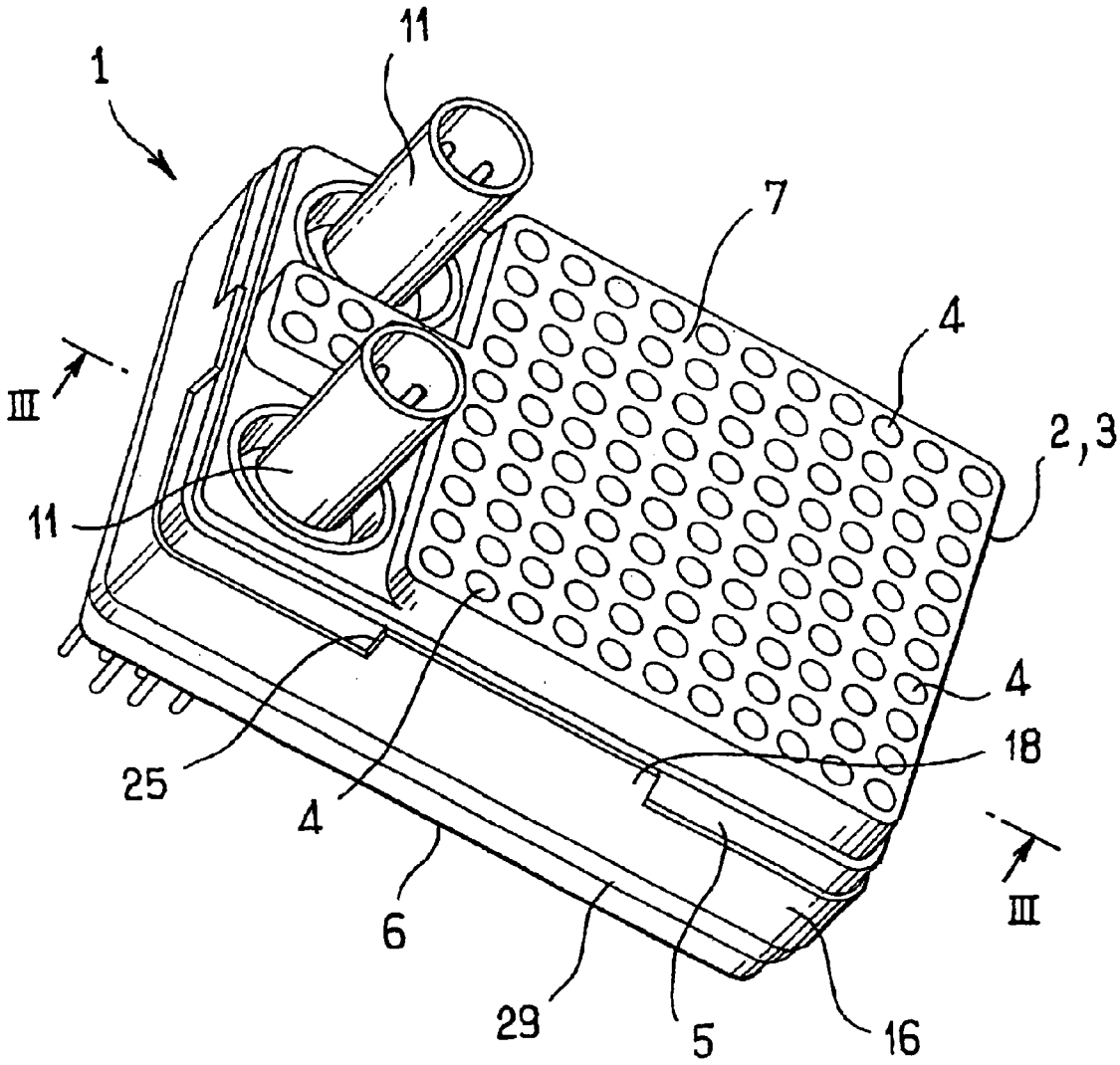
FIG. 2 is a diagrammatic and fragmentary perspective view of the FIG. 1 connection block once assembled.
Figure 3:
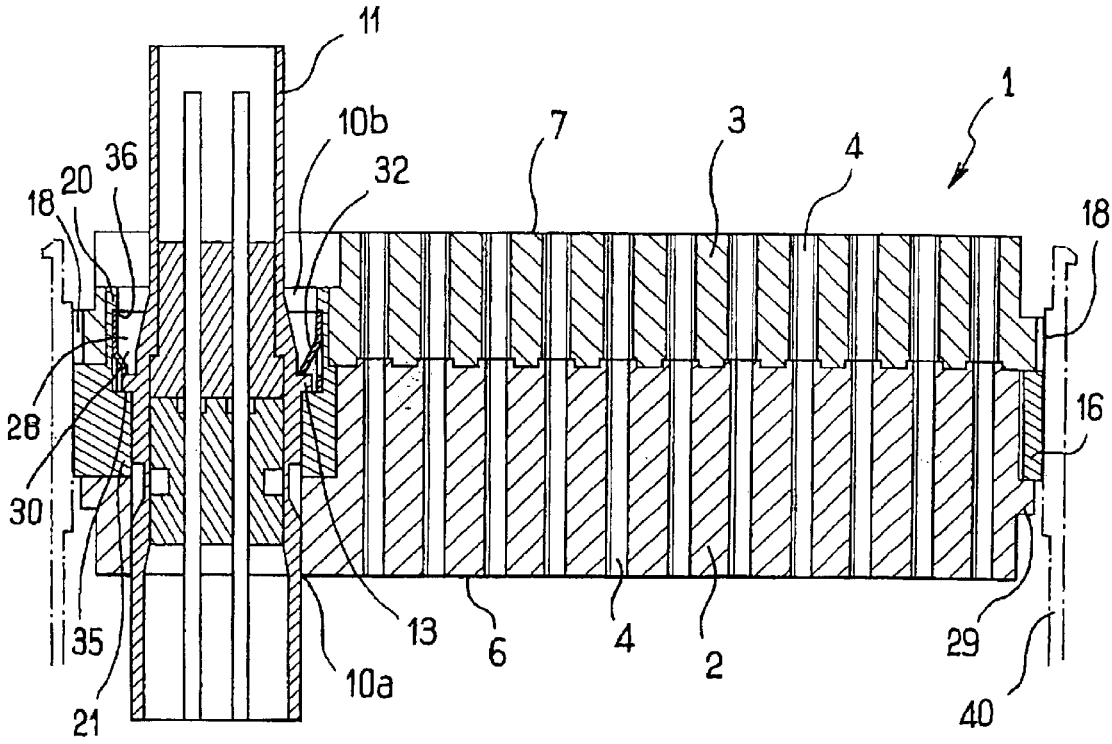
FIG. 3 is a diagrammatic and fragmentary section view on III—III showing the FIG. 2 connection block mounted in a box.

As can be seen in FIG. 2, once assembled, the insulating body 2, 3 is substantially in the form of a rectangular parallelepiped, having bottom and top faces 6 and 7 and a side wall 5 extending between these two faces 6 and 7.

The insulating body 2, 3 has a plurality of holes 4 extending between the top and bottom faces 6 and 7, each being designed to receive an individual contact (not shown).

Each of the bottom and top portions 2 and 3 has two respective orifices 10*a* or 10*b*, with each orifice 10*a* being situated in register with an orifice 10*b*.

The bottom portion 2 has a bearing surface 19 defined by a plane surface extending on a peripheral collar 29 of said portion 2 and around the orifices 10*a*, thus providing two setbacks 9 around the orifices 10*a*.

The connection block 1 has a metal ground element 15 having a substantially annular contact wall 16 parallel to the side wall 5 of the insulating body.

This contact wall 16 is of substantially rectangular cross-section.

The contact wall 16 is of constant height except in regions 18 which are of greater height.

There are four such regions 18, each being situated on a respective side of the contact wall 16 and each extending upwards in the figures.

Each of these regions 18 engages in a recess 25 of the top portion 3, as can be seen in FIGS. 1 and 2.

As shown in FIG. 2, seen from the outside the contact wall 16 appears as a band extending all around the side wall 5.

The metal ground element 15 has two internal portions 21 situated in the inside space defined by the contact wall 16.

Each internal portion 21 has a housing 28 that is extended upwards by a cylindrical neck 20.

Each of these housings 28 is designed to receive a respective ground pin 11.

Each ground pin 11 comprises a tubular body 12 having a collar 13 whose function is explained below.

Each internal portion 21 is suitable for engaging in a setback 9 of the bottom portion 2 of the insulating body so that once the connection block has been assembled, the internal portions 21 are sandwiched between the bottom and top portions 2 and 3 of the insulting body, and the necks 20 are engaged in respective orifices 10*b* of the top portion 3.

The contact wall 16 is then held between the collar 29 and the bottom face of the top portion 3.

The inside surface of the housing 28 presents both a first shoulder 35 against which the collar 13 of the pin 11 comes to bear, and a second shoulder 36.

Each housing 28 receives an annular retaining ring 30 which is split so as to enable it to be deformed elastically in the radial direction.

Each ring 30 is suitable for being inserted in a housing 28 by being deformed radially and for being retained therein between the shoulders 35 and 36.

Each ring 30 further comprises a plurality of elastically deformable tabs 32 suitable for bearing against the collar 13 of the corresponding ground pin 11 when the pin is inserted in the housing 28.

In the example described, the ground element 15 is made as a single piece of aluminum alloy coated in a layer of nickel.

After assembly, the connection block 1 is inserted into a cavity in a metal box 40 of a multicontact connector, which is shown diagrammatically and which is made of aluminum alloy.

What is claimed is:

1. A connection block configured for being inserted in a cavity of a metal box of a multicontact connector, the block comprising:

an insulating body having a bottom face and a top face together with an annular side wall extending substantially between said faces, said insulating body being provided with a plurality of holes configured to receive individual contacts, said holes extending between said bottom and top faces;

one or more housings each configured to receive a ground pin and each situated in at least one orifice of the insulating body; and a metal ground element configured for being electrically connected to the ground pin(s) inserted in said housing (s), said ground element having a contact wall configured to extend over at least a major portion around said annular side wall.

2. A block according to claim 1, wherein said contact wall extends all around the side wall of the insulating body.

3. A block according to claim 1, wherein said contact wall extends over at least a fraction of the height of said side wall.

4. A block according to claim 1, wherein said side wall of the insulating body and said contact wall of the metal ground element are both substantially rectangular in cross-section.

5. A block according to claim 1, wherein said contact wall has regions of greater height than the remainder of said contact wall.

6. A block according to claim 1, wherein the insulating body comprises at least one bearing surface against which said ground element can come to bear.

7. A block according to claim 1, wherein the ground element is made integrally.

8. A block according to claim 1, wherein the ground element is made of aluminum alloy coated in a layer of nickel.

9. A multicontact connector comprising:

a metal box having one or more cavities; and one or more connection blocks according to claim 1, each inserted is a cavity of the box.

10. A block according to claim 1, wherein the insulating body has a bottom portion and a top portion that are separate and suitable for being assembled together, and wherein the metal ground element has one or more internal portions forming said one or more housings each configured to receive a ground pin, said internal portion(s) being sandwiched at least in part between said bottom and top portions of the insulating body when said portions are assembled together.

11. A block according to claim 10, at least one of said portions of the insulating body having an orifice, wherein each internal portion of the metal ground element has a cylindrical neck engaging in said orifice of a portion of the insulating body.

12. A block according to claim 11, comprising one or more retaining rings suitable for being inserted in respective housings of the metal ground element and arranged to retain a ground pin in said housing.

13. A connection block configured for being inserted in a cavity of a metal box of a multicontact connector, the block comprising:

an insulating body having a bottom face and a top face together with an annular side wall extending substantially between said faces, said insulating body being provided with a plurality of holes configured to receive individual contacts, said holes extending between said bottom and top faces; said insulating body having a bottom portion and a top portion that are separate and configured for being assembled together, one or more housings each configured to receive a ground pin; and a metal ground element configured for being electrically connected to the ground pin(s) inserted in said housing (s), said ground element having a contact wall configured to extend over at least a major portion around said side wall, wherein the metal ground element has one or more internal portions forming said one or more housings each configured to receive a ground pin, said internal portion(s) being sandwiched at least partially between said bottom and top portions of the insulating body when said portions are assembled together.

* * * * *